US006043594A

United States Patent [19]

Huang

[11] Patent Number: 6,043,594

[45] Date of Patent: Mar. 28, 2000

[54] CHRISTMAS LAMP DRAINAGE STRUCTURE

[76] Inventor: Shun-Feng Huang, 56, Minsheng Street, Fengyuan, Taichung Hsien, Taiwan

[21] Appl. No.: 09/009,592

[22] Filed: Jan. 20, 1998

[51] Int. Cl.[7] ..... H01J 5/54

[52] U.S. Cl. ..... 313/318.09; 362/226; 439/619

[58] Field of Search ..... 313/318.01, 318.09, 313/318.1; 362/226, 249, 238, 441, 389, 806; 439/619, 375

[56] References Cited

U.S. PATENT DOCUMENTS

| | | | |
|---|---|---|---|
| 4,999,751 | 3/1991 | Chen | 362/226 |
| 5,531,610 | 7/1996 | Chen | 439/619 |
| 5,620,343 | 4/1997 | Pan | 439/619 |
| 5,707,138 | 1/1998 | Pan | 362/226 |
| 5,709,457 | 1/1998 | Hara | 362/226 |
| 5,722,771 | 3/1998 | Wang | 362/249 |

*Primary Examiner*—Michael H. Day

[57] ABSTRACT

An improved structure Christmas lamp drainage, it mainly comprising a bulblet socket and a bulblet stand, a bulblet is inserted into the bulblet socket. The bulblet socket has a stopping ring, a circular body and a dual-angular body, two locking pieces and two vertical recesses are disposed on the stopping ring, a concave angular is between the dual-angular body. The bulblet stand has a cylindrical boy and a flat body, two locking holes and two tubes are disposed on top edge of the cylindrical body, the flat body has a partition piece. Accordingly, insert the locking pieces of the bulblet socket into the locking holes of the bulblet stand, with the vertical recesses correspond to the tubes, the concave angle is disposed on top of the partition piece, water inside the bulblet stand can thus be drained outside through the vertical recesses and the tubes.

1 Claim, 4 Drawing Sheets

CHRISTMAS LAMP DRAINAGE STRUCTURE

BACKGROUND OF THE INVENTION

The invention relates to an improved Christmas lamp drainage structure. The conventional serial Christmas lamps are usually for outdoor use and can get wet by rain or snow, thus electric shock might occur due to lack of drainage design. Some Christmas lamps are designed to have drainage function but are relatively complicated in structure and are not effective.

The present invention mainly comprising a bulblet, a bulblet socket, and a bulblet stand. The bulblet is inserted into the bulblet socket with a stopping ring. Two locking pieces are extended under the stopping ring. A circular body is disposed under the stopping ring, a dual-angular body is located under the circular body. The bulblet is inserted inside the hollow body and two filaments of the bulblet go through the dual-angular body and are disposed outside. The bulblet stand has a cylindrical body on the upper part and a flat body on the lower part. A partition piece is disposed inside the flat body with insertion troughs on the inner surfaces for copper plates of a wire to insert. Two opposite vertical recesses are disposed on the stopping ring and the hollow body. Two opposite locking holes are disposed on the top edge of the circular body, two opposite tubes are extended from the side of the hollow body in corresponding to the vertical recesses of the. bulblet socket for drainage of water. Accordingly, the locking pieces under the stopping ring of the bulblet socket are locked into the locking holes of the bulblet stand, the concave angle between the dual-angular body of the bulblet socket is placed on top of the partition piece of the bulblet stand. Rain can thus be drained outside the bulblet stand.

SUMMARY OF THE INVENTION

The main objective of the invention is to provide an improved structure that can drain rain water or snow from inside the bulblet stand. The other objective is to minimize the chance of occurrence of electric shock.

DETAILED DESCRIPTION OF THE INVENTION

Figure 1:
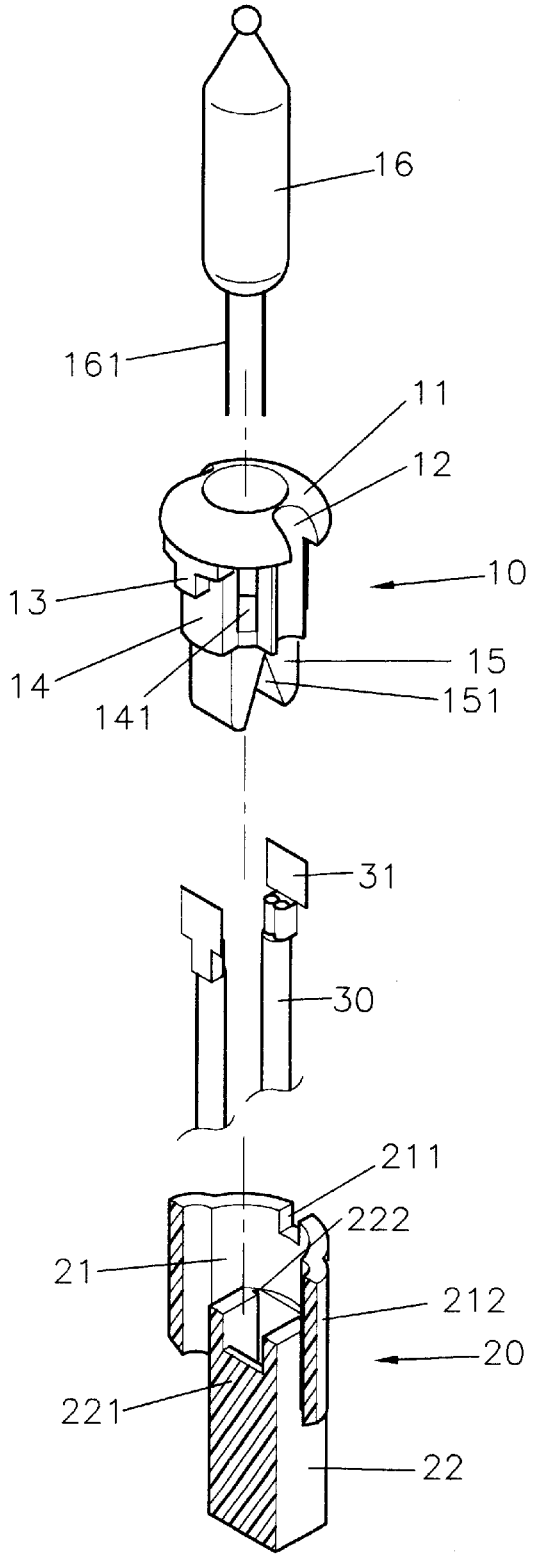
FIG. 1 is an exploded perspective view of the invention.
Figure 3:
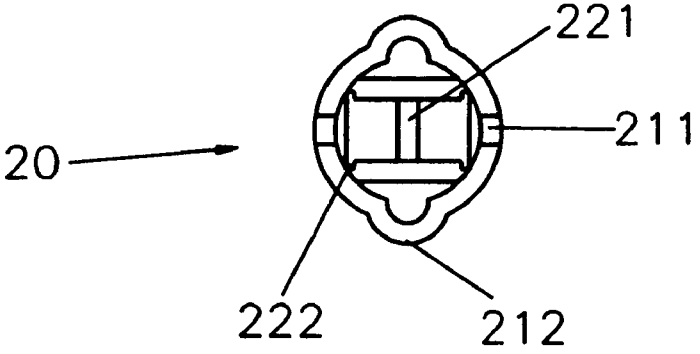
FIG. 3 is a top view of a bulblet stand of the invention.
Figure 2:
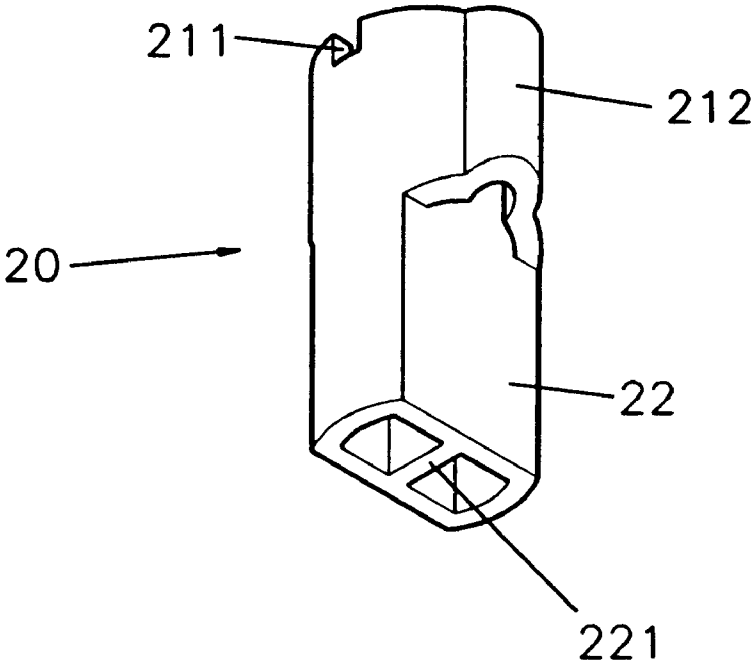
FIG. 2 is a perspective view of a bulblet stand of the invention.
Figure 5:
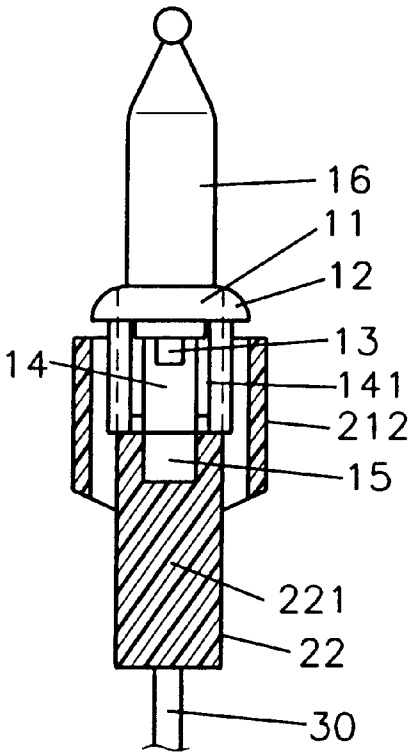
FIG. 5 is a y-axial sectional view of the invention.
Figure 4:
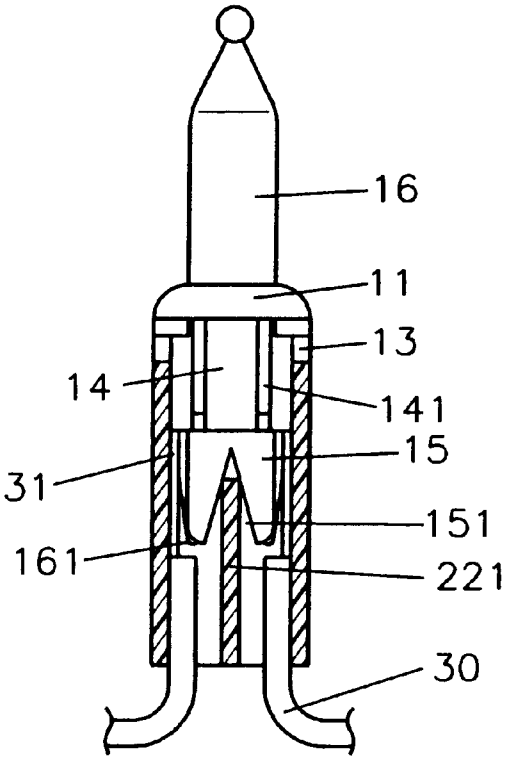
FIG. 4 is a x-axial sectional view of the invention.
Figure 6:
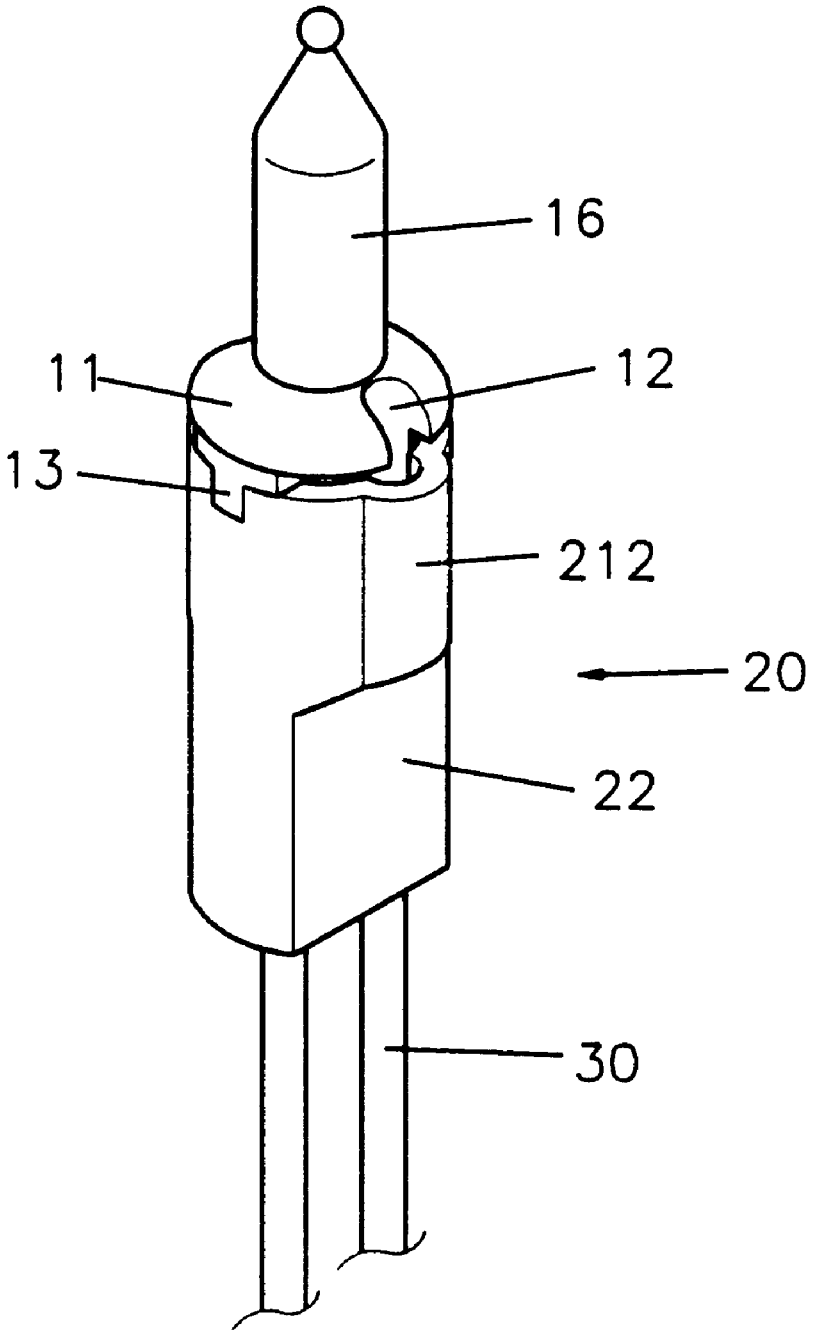
FIG. 6 is an assembly view of the invention.

Referring to FIGS. 1, 2 & 3, it mainly comprising a bulblet socket 10 and a bulblet stand 20, the bulblet socket has a stopping ring 11 with two opposite vertical recesses 12 extended downwards. Two locking pieces 13 are disposed on the sides under the stopping ring 11. A circular body 14 with a hollow hole 141 is disposed right under the stopping ring 11. A dual-angular body 15 is extended from the bottom of the circular body 14, a concave angle 151 is found between the dual-angular body 15, holes are available in the dual-angular body 15 for penetration of lead-in wires 161 of a bulblet 16. The bulblet stand 20 is a combination of a cylindrical body 21 and a flat body 22. Two locking holes 211 are disposed on the top edge of the cylindrical body 21 corresponding to the locking pieces 13 of the bulblet socket 10. Two tubes 212 are disposed on the other two opposites sides of the cylindrical body 21 in corresponding to the vertical recesses 12 of the bulblet socket. A partition piece 221 is disposed inside the flat body 22. Referring to FIG. 4, two insertion troughs 222 are disposed on the inner walls of the flat body 22 for insertion of two copper plate 31 of wires 30. Referring to FIGS. 4 & 5, insert the bulblet 16 into the bulblet socket 10 and let the lead-in wires 161 of the bulblet 16 exposed outside the dual-angular body 15 of the bulblet socket 10. Then insert the bulblet socket 10 into the bulblet stand 20, so that the locking pieces 13 of the bulblet socket 10 lock into the locking holes 211 of the bulblet stand 20, also the tubes 212 are inserted into the vertical recesses 12. The concave angle 151 between the dual-angular body 15 is disposed on top of the partition piece 221, the copper plates 31 of the wires 30 are inserted into the insertion troughs 222 of the flat body 22. Rain water or snow can thus be drained outside the bulblet stand through the vertical recesses 12 of the bulblet socket 10 and the tubes 212 of the bulblet stand 20. The partition piece 221 can separate the lead-in wires 161 and the copper plates 31 to make electric shock impossible.

I claim:

1. A drainage device for Christmas lamp comprising:

a bulblet having a pair of lead-in wires extending downward from bottom thereof;

a bulblet socket for receiving said bulblet comprising a stopping ring on an upper rim including a pair of vertical recesses in opposing circumferences and a pair of locking pieces extending downward from opposing undersides, a hollow circular body positioned under said stopping ring, a dual-angular body, extending downward from said hollow circular body for attaching the lead in wires of said bulblet and a concave angle being defined between said dual-angular body, wherein said lead-in wire pass through said concave angle and expose to outward surfaces of said dual-angular body respectively;

a bulblet stand for engaging with said bulblet socket comprising cylindrical body engaged with said bulblet socket, a flat body extending downward from said cylindrical body including a partition at center and a pair of insertion troughs in opposing inner walls for respectively inserting a pair of copper plates from a pair of electrical wires which insert in from underside of said flat body, a pair of locking holes formed in opposing upper rim of said cylindrical body respectively engaged with the pair of locking pieces of said bulblet socket and a pair of tube members formed in opposing peripheral walls perpendicular to said locking holes and engaged with the vertical recesses of said bulblet socket to define a pair of drainage ways therein;

whereby, water of rain or snow is drained out of the lamp through said drainage ways.

* * * * *